US009013363B2

(12) United States Patent
Ma et al.

(10) Patent No.: US 9,013,363 B2
(45) Date of Patent: Apr. 21, 2015

(54) METHOD FOR REALIZING TERMINAL ANTENNA, TERMINAL ANTENNA AND TERMINAL THEREOF

(75) Inventors: Weitao Ma, Shenzhen (CN); Fengyu Liu, Shenzhen (CN)

(73) Assignee: ZTE Corporation, Shenzhen, Guangdong Province (CN)

( * ) Notice: Subject to any disclaimer, the term of this patent is extended or adjusted under 35 U.S.C. 154(b) by 247 days.

(21) Appl. No.: 13/501,501

(22) PCT Filed: Apr. 30, 2010

(86) PCT No.: PCT/CN2010/072374

§ 371 (c)(1), (2), (4) Date: Apr. 12, 2012

(87) PCT Pub. No.: WO2011/079562

PCT Pub. Date: Jul. 7, 2011

(65) Prior Publication Data

US 2012/0256807 A1 Oct. 11, 2012

(30) Foreign Application Priority Data

Dec. 31, 2009 (CN) ..... 2009 1 0266519

(51) Int. Cl.

| | |
|---|---|
| ***H01Q 1/50*** | (2006.01) |
| ***H01Q 9/04*** | (2006.01) |
| ***H01P 11/00*** | (2006.01) |
| ***H01Q 1/24*** | (2006.01) |

(Continued)

(52) U.S. Cl.

CPC ..... *H01Q 1/243* (2013.01); *Y10T 29/49016* (2015.01); *H01Q 1/44* (2013.01); *H01Q 1/48* (2013.01)

(58) Field of Classification Search

CPC ..... H01Q 1/44

See application file for complete search history.

(56) References Cited

U.S. PATENT DOCUMENTS

| | | | | |
|---|---|---|---|---|
| 4,223,317 | A * | 9/1980 | Rod | 343/803 |
| 5,914,696 | A * | 6/1999 | Vanderhelm et al. | 343/702 |
| 6,218,992 | B1 | 4/2001 | Sadler et al. | |

(Continued)

FOREIGN PATENT DOCUMENTS

| | | | |
|---|---|---|---|
| CN | 1643727 | A | 7/2005 |
| CN | 1917281 | A | 2/2007 |

(Continued)

OTHER PUBLICATIONS

International Search Report oated Nov. 4, 2010 for PCT/CN2010/072374.

*Primary Examiner* — Michael C Wimer
*Assistant Examiner* — Michael Bouizza
(74) *Attorney, Agent, or Firm* — Banner & Witcoff, Ltd.

(57) ABSTRACT

Provided is a method for implementing a terminal antenna, including: welding a metal shell for fixing a side key on a ground of a printed circuit board; dividing the ground of the printed circuit board into a first ground and a second ground, connecting the first ground with the second ground by at least one first isolating unit, the first ground being welded with the metal shell, and a length of the first ground being ¼ of a wavelength of a radio operating frequency band, and connecting the first ground with an antenna receiving/transmitting unit, thereby implementing a terminal antenna by taking the first ground as a radiator. The present invention also provides a corresponding terminal antenna and a terminal thereof.

13 Claims, 1 Drawing Sheet

(51) Int. Cl.
*H01Q 1/44* (2006.01)
*H01Q 1/48* (2006.01)

(56) References Cited

U.S. PATENT DOCUMENTS

| | | | | |
|---|---|---|---|---|
| 6,545,642 | B1 * | 4/2003 | Doub et al. | 343/702 |
| 7,595,759 | B2 * | 9/2009 | Schlub et al. | 343/702 |
| 2008/0074329 | A1 * | 3/2008 | Caballero et al. | 343/702 |
| 2008/0166004 | A1 | 7/2008 | Sanford et al. | |
| 2009/0061966 | A1 | 3/2009 | Yang et al. | |
| 2009/0179802 | A1 | 7/2009 | Tsai et al. | |
| 2009/0278752 | A1 * | 11/2009 | Oh | 343/702 |

FOREIGN PATENT DOCUMENTS

| | | | |
|---|---|---|---|
| CN | 101505000 | A | 8/2009 |
| WO | 2009/000815 | A1 | 12/2008 |

* cited by examiner

METHOD FOR REALIZING TERMINAL ANTENNA, TERMINAL ANTENNA AND TERMINAL THEREOF

TECHNICAL FIELD

The present invention relates to the antenna field, and particularly to a method for implementing a terminal antenna, a terminal antenna and a terminal thereof.

BACKGROUND OF THE RELATED ART

With the fast development of mobile communication terminals, additional functions, besides a basic conversation function, of a terminal become more and more, and as for as the current mainstream market is concerned, a terminal is generally integrated with functional modules such as Bluetooth, radio, Global Positioning System (GPS), and even digital television, and the Bluetooth has actually become a standard additional functional module of most terminals. Each module needs a different antenna as a radiator device because of different operating radio frequency band. The current trend that the size of the terminal is smaller and smaller, the difficulty of integrating more and more antennas is higher and higher due to limitation of size, meanwhile another problem that is brought along is interference between antennas of different modules.

In term of the current mainstream technology, different antennas have different implementation ways, and the common ways comprises:

a patch antenna, there are various production technologies for such antenna, such as, in general, ceramic technology, Low Temperature Cofired ceramic (LTCC) technology and the like, and such a patch antenna is produced by specialized antenna manufacturers and is patched onto different terminals as a general part, an advantage of which is superiority in price because of large amount, and a disadvantage is fewer antenna adjusting points and the need of a specialized antenna space.

A custom antenna, which is mainly designed and adjusted by a specialized antenna manufacturer for different terminals, and has a relative more inflexible implementation way, the forms of such antenna comprise Planar Inverted F Antenna (PIFA), MONOPOLE and so on, and the structure is implemented by an individually made bracket, with a specialized antenna space and meanwhile a higher price.

SUMMARY OF THE INVENTION

The technical problem that the present invention solves is to provide a method for implementing a terminal antenna, a terminal antenna and a terminal thereof such that a currently existing terminal standard equipment—side key—is unitized and functions as an antenna based on the antenna theory, thereby saving space effectively.

In order to solve the above-mentioned technical problem, the present invention provides a method for implementing a terminal antenna, comprising:

welding a metal shell for fixing a side key onto a ground of a printed circuit board;

dividing the ground of the printed circuit board into a first ground and a second ground, connecting the first ground with the second ground by at least one first isolating unit, the first ground being welded with the metal shell, and a length of the first ground being ¼ of a wavelength of a radio operating frequency band;

connecting the first ground with an antenna receiving/transmitting unit;

thereby implementing the terminal antenna by taking the first ground as a radiator.

The above implementation method has the following characteristics:

the radio operating frequency band is a Bluetooth operating frequency band, and the length of the first ground is 30 mm;

or, the radio operating frequency band is a Global Positioning System (GPS) frequency band, and the length of the first ground is 48 mm.

The above implementation method has the following characteristics:

the first ground is connected to the antenna receiving/transmitting unit by a matching unit, and the matching unit is configured to match an impedance of the radiator to an input impedance of the antenna receiving/transmitting unit.

The above implementation method has the following characteristics:

the matching unit is a T-network composed of an inductor and an capacitor.

The above implementation method has the following characteristics: the method further comprises:

connecting the first ground to a corresponding side key signal wire by a second isolating unit.

The above implementation method has the following characteristics:

the at least one first isolating unit is close to the first ground and is distributed evenly;

the second isolating unit is close to the first ground.

The present invention also provide a terminal, comprising a printed circuit board, at least one side key with a metal shell and an antenna receiving/transmitting unit connected onto the printed circuit board, wherein, the printed circuit board comprises a first ground connected with the antenna receiving/transmitting unit, and a second ground connected with the first ground by at least one first isolating unit, the first ground is connected to the metal shell of the side key, a length of the first ground is ¼ of a wavelength of a radio operating frequency band, and the first ground serves as a radiator of a terminal antenna.

The above terminal has the following characteristics:

the radio working frequency band is a Bluetooth operating frequency band, and the length of the first ground is 30 mm;

or, the radio operating frequency band is a Global Positioning System (GPS) frequency band, and the length of the first ground.

The above terminal further comprises a matching unit, wherein, the first ground is connected with the antenna receiving/transmitting unit by the matching unit;

the matching unit is configured to match an impedance of the radiator to an input impedance of the antenna receiving/transmitting unit.

The above terminal has the following characteristics:

the matching unit is a T-network composed of an inductor and a capacitor.

The above terminal further comprises a second isolating unit, wherein, the first ground is connected with a corresponding side key signal wire by the second isolating unit.

The above terminal has the following characteristics:

the at least one first isolating unit is close to the first ground and is distributed evenly;

the second isolating unit is close to the first ground.

The present invention also provides a terminal antenna, comprising a first ground and at least one side key with a metal shell, wherein, the first ground is connected to the metal shell of the side key, and a length of the first ground is ¼ of a wavelength of a radio operating frequency band.

The above terminal antenna has the following characteristics:

the first ground is further configured to:

be connected with a second ground of a printed circuit board by at least one first isolating unit; or be connected with a corresponding side key signal wire by a second isolating unit; or be connected with an antenna receiving/transmitting unit by a matching unit; the matching unit is configured to match an impedance of a radiator to an input impedance of the antenna receiving/transmitting unit.

The above terminal antenna has the following characteristics:

the radio operating frequency band is a Bluetooth operating frequency band, and a length of the first ground is 30 mm;

or, the radio operating frequency band is a Global Positioning System (GPS) frequency band, and the length of the first ground is 48 mm.

According to the method for implementing a terminal antenna, the terminal antenna and the terminal thereof provided by the present invention, since the side key is located outside a terminal and has a good radiation effect, a currently existing terminal standard accessory—side key—is utilized and functions as an antenna based on the antenna theory in the present invention without influencing the functions of the side key itself, thereby saving space effectively and reducing costs.

PREFERRED EMBODIMENTS OF THE PRESENT INVENTION

A side key may serve as a shortcut start key of functions such as taking photographs and volume adjusting, and has become a standard configuration of most terminals currently. Since the side key is located outside a terminal and has a good radiation effect, the present invention provides a new idea of utilizing the side key as an antenna so as to solve current technical and engineering problems.

Preferred examples of the technical scheme of the terminal antenna according to the present invention will be further described in detail below.

Figure 1:
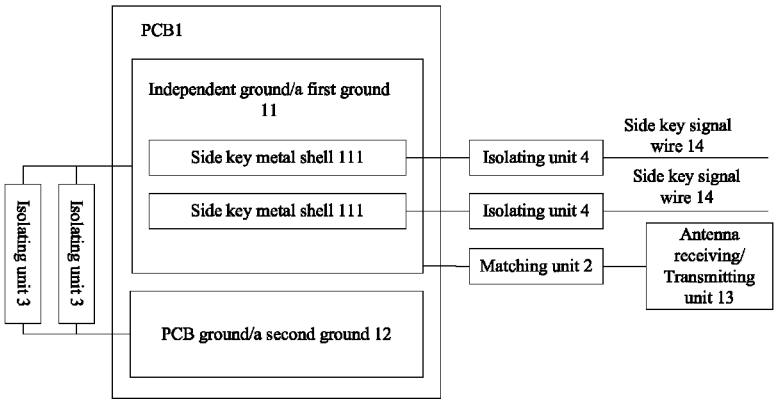
FIG. 1 is a schematic diagram of a terminal antenna according to an example of the present invention.

A terminal according to the present example comprises a side key, which is welded on a ground wire of a Printed Circuit Board (PCB) 1 through a metal shell 111. FIG. 1 is a schematic diagram of a terminal antenna according to the example of the present invention, wherein only two side key metal shells 111 are shown. As shown in the figure, the part of PCB 1 welded with the side key 111 and the metal shell 111 of the side key are collectively called as an independent ground 11 (also called as a first ground 11), the two side key metal shells 111 are both a part of the independent ground 11, and the length of the independent ground 11 is about ¼ of the wavelength of a specific radio operating frequency band.

For example, the wavelength of a Bluetooth operating frequency band is 0.125 m, ¼ of the wavelength of the Bluetooth operating frequency band is about 30 mm, so the length of the independent ground 11 is about 30 mm, and thus the independent ground 11 may serve as a radiator of an antenna. The independent ground 11 is a radiator for a high-frequency signal and can radiate out the high-frequency signal, while it still has a function of ground for a low-frequency signal.

The radiator 11 is connected with an antenna receiving/transmitting unit 13 by a matching unit 2. The matching unit 2 may be a T-network composed of an inductor and a capacitor, and the role of the matching unit 2 is to match an impedance of the radiator to the input impedance of an antenna receiving/transmitting unit 13.

Thus, the side key on a terminal according to the present example may also function as an antenna, thereby saving space effectively and reducing costs.

Further, the ground network on the PCB 1 other than the independent ground 11 is called as a PCB ground 12 (also called as a second ground 12), and an isolating unit 3 (e.g., an inductor) is connected between the independent ground 11 and the PCB ground 12 in series. The isolating unit 3 should be close to the independent ground 11 as much as possible so as to prevent the radio signal of the operating frequency band from being interfered, and meanwhile avoid the signals of other non-operating frequency bands from being radiated out.

The side key has to be connected with a side key signal wire 14 to complete the key function. The side key signal wire 14 is a digital signal wire with a lower rate but still influences the radiator. For example, the side key signal wire may interfere with the Bluetooth antenna, so the side key signal wire 14 needs an isolation treatment, the way of which is to connect an isolating unit 4 (e.g., an inductor) with the side key signal wire 14 in series, that is, the side key signal wire 14 (independent ground) is connected with the radiator 11 via the isolating unit 4. The isolating unit 4 has to be located close to the radiator 11 in a specific layout of the PCB 1.

Figure 2:
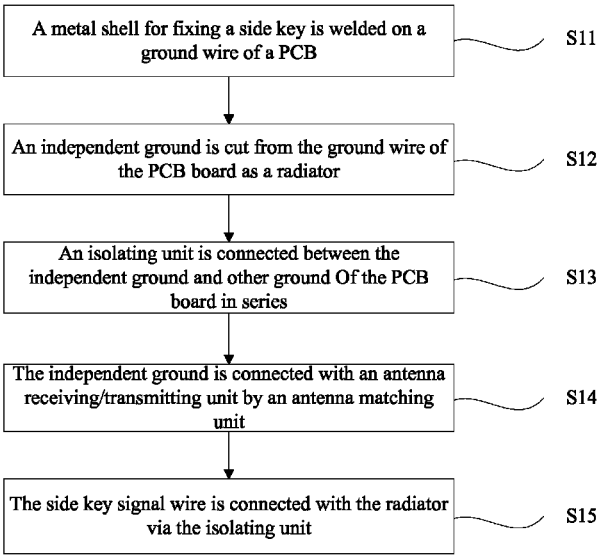
FIG. 2 is a flowchart of a method for implementing a terminal antenna according to an example of the present invention.

FIG. 2 is a flowchart of a method for implementing a terminal antenna according to an example of the present invention. As shown in FIG. 2, the present example comprises the following steps.

In step S11, a metal shell for fixing a side key is welded on a ground wire of a PCB;

taking a patch side key as an example, a case shell of the patch side key is metallic, and this metal case shell is welded on the PCB for fixing the side key. The area welded with the side key case shell on the PCB belongs to a ground wire network of the whole PCB.

In step S12, an independent ground is cut from the ground wire network of the PCB board as a radiator;

The independent ground is a ground that has a specific length including the metal shell of the side key, and the specific length is related to ¼ of the wavelength of a practical radio operating frequency band.

Taking a most common terminal with two side keys as an example, the ground on the PCB located between two side key metal shells is called as a partial ground 2, the ground located at one side of the two side key metal shells is called as a partial ground 1, and the ground located at the other side of the two side key metal shells is called as a partial ground 3.

The valid length of the independent ground (including the side key metal shell and the partial grounds 1, 2, 3) is close to ¼ of the wavelength of an electromagnetic wave of a Bluetooth radio operating frequency band (2.4 GHz). The wavelength of the electromagnetic wave of Bluetooth radio operating frequency band is 0.125 m, ¼ of which is about 30 mm, and according to the antenna radiation theory, a metal object with a valid length of ¼ of the wavelength in the operating frequency band may be used as a radiator.

As for other operating frequency bands, for example, a wavelength of GPS is 0.1905 m, ¼ of which is about 48 mm. Then, at this moment, the independent ground may serve as a radiator with the length being limited to about 48 mm.

Of course, the number of side keys may vary, for example, there may be one side key or more than two side keys. The number of the side key metal shells included in a radiator may be determined based on ¼ of the wavelength of an operating frequency band. For example, when a terminal has three side keys, if the length of two of them plus the length of the surrounding ground meets the length requirement of ¼ of the wavelength of the operating frequency band, then the radiator may only comprise the two side key metal shells. Similarly, the radiator may only comprise one side key.

In a similar way, for the case of only one side key, the length of the ground surrounding the side key metal shell should be adjusted appropriately to make the length of the radiator (i.e., the independent ground) equivalent to ¼ of the wavelength of the operating frequency band.

In step S13, an isolating unit is connected between the radiator and the PCB ground in series;

The role of the isolating unit is to separate the independent ground from the PCB ground, and make the independent ground serve as a radiator in the operating frequency band, and make the independent ground still be connected with the PCB ground as a ground network in the meantime.

The ground network on the PCB other than the independent ground is called as a PCB ground, and when the PCB is designed, the independent ground is separated from the PCB ground, and an isolating unit (e.g. an inductor) is connected between the independent ground and the PCB ground in series. The isolating unit can isolate passing of a high-frequency signal (e.g. Bluetooth operating frequency band 2.4 GHz) but does not isolate a low-frequency signal or a D.C. (direct current) signal.

The number and location of the isolating units may influence a grounding effect of the side key, so the number and location of the isolating units may be changed according to the actual grounding demands; the more the isolating units are, the smaller the D.C. impedance between the independent ground and the PCB ground is, that is to say, the better the grounding performance is; and a poor grounding performance will cause an interference between different circuit modules.

With regard to radio frequency, the locations of isolating units, which are analogous to the locations of grounding points, are distributed as evenly as possible.

The isolating unit between the independent ground and the PCB ground has to be located close to the independent ground as much as possible. Preferably, one end of the isolating unit is directly located on the independent ground.

In step S14, the radiator is connected with an antenna receiving/transmitting unit by an antenna matching unit;

According to the present embodiment, the independent ground serves as a radiator of an antenna and is connected with the antenna receiving/transmitting unit (e.g. a Bluetooth receiving/transmitting unit) by the antenna matching unit, and the role of the antenna matching unit is to match the impedance of the radiator to an input impedance of the antenna receiving/transmitting unit.

According to an antenna matching principle, the antenna matching unit has to be located close to the independent ground as much as possible. Preferably, the matching unit is directly connected to the independent ground.

According to a basic principle of antenna matching, the matching unit may be implemented using a T-network composes of a capacitor and an inductor.

Further, a D.C. blocking capacitor is added between the matching unit and the transmitting/receiving unit to protect the D.C. signal of the transmitting/receiving unit from being influenced by the matching unit.

In step S15, the side key signal wire is connected with the radiator via the isolating unit;

A signal wire needs to pass in and out of the side key for completing a button function of the side key, wherein the side key signal wire is a digital signal wire with a lower rate but still influences the radiator. The side key signal may interfere with the Bluetooth antenna, so the signal wire needs an isolating treatment, the way of which is to connect an isolating unit (e.g., an inductor) with the side key signal wire in series, that is, the side key signal wire is connects with the radiator (independent ground) via the isolating unit. The isolating unit has to be located close to the radiator as much as possible in a specific layout of PCB.

The method according to the present example may implement the function of a side key serving as an antenna, which may save space effectively and reduce costs.

Moreover, the isolating unit according to the present example may be implemented using a series connected inductor, or may be implemented using other means through adjustments; by way of changing the length of the radiator, i.e. the independent ground, the radiator may be also applied to other non-Bluetooth frequency bands such as GPS, provided that the length of the radiator is equal to ¼ of the wavelength of the electromagnetic wave in this operating frequency band; the number of side keys may vary and a non-inductor way may also be adopted; the matching unit may be implemented by adopting a non-T network.

The present invention also provide a terminal antenna, comprising a first ground and at least one side key with a metal shell, wherein, the first ground is connected to the metal shell of the side key, and the length of the first ground is ¼ of the wavelength of the radio operating frequency band.

The first ground is also configured to be connected to a second ground of a printed circuit board by at least one first isolating unit;

be connected to a corresponding side key signal wire by a second isolating unit;

be connected to an antenna receiving/transmitting unit by a matching unit; the matching is configured to match the impedance of the radiator to the input impedance of the antenna receiving/transmitting unit.

The at least one first isolating unit is close to the first ground and is distributed evenly;

the second isolating unit is close to the first ground;

the radio operating frequency band is a Bluetooth operating frequency band, and the length of the first ground is 30 mm;

or, the radio operating frequency band is a Global Positioning System (GPS) frequency band, and the length of the first ground is 48 mm.

Those skilled in the art can make various corresponding changes and variations according to the present invention without departing from the spirit and substance of the present invention. However these changes and variations shall fall into the protection scope of claims appended to the present invention.

INDUSTRIAL APPLICABILITY

According to the method for implementing a terminal antenna, a terminal antenna and a terminal thereof provided by the present invention, since the side key is located outside a terminal and has a good radiation effect, a currently existing terminal standard accessory—side key—is utilized and functions as an antenna based on the antenna theory in the present invention without influencing the functions of the side key itself, thereby saving space effectively and reducing costs.

What is claimed is:

1. A method for implementing a terminal antenna, comprising:

welding a side key onto a ground of a printed circuit board, PCB, by a metal shell for fixing the side key; wherein the part of PCB welded with the side key and the metal shell of the side key collectively form a first ground, and a length of the first ground being ¼ of a wavelength of a radio operating frequency band; a ground on the PCB except the first ground form a second ground;

connecting the first ground with the second ground by at least one first isolating unit, wherein the first isolating unit is used to preventing the radio signal of an operating frequency band from being interfered, and meanwhile avoiding the signals of a non-operating frequency bands from being radiated out;

connecting the first ground with an antenna receiving/transmitting unit;

connecting the first ground to a corresponding side key signal wire by a second isolating unit, wherein the second isolating unit is configured to avoid the side key signal wire interfering with the first ground;

thereby implementing the terminal antenna by taking the first ground as a radiator.

2. The method according to claim 1, wherein, the radio operating frequency band is a Bluetooth operating frequency band, and the length of the first ground is 30 mm;

or, the radio operating frequency band is a Global Positioning System (GPS) frequency band, and the length of the first ground is 48 mm.

3. The method according to claim 1, wherein the step of connecting the first ground with an antenna receiving/transmitting unit comprising:

connecting the first ground to the antenna receiving/transmitting unit by a matching unit, wherein the matching unit is configured to match an impedance of the radiator to an input impedance of the antenna receiving/transmitting unit.

4. The method according to claim 3, wherein, the matching unit is a T-network composed of an inductor and a capacitor.

5. The method according to claim 1, wherein, the at least one first isolating unit is close to the first ground and is distributed evenly;

the second isolating unit is close to the first ground.

6. A terminal, comprising a printed circuit board, PCB, at least one side key with a metal shell for fixing the at least one side key, an antenna receiving/transmitting unit connected onto the printed circuit board and a second isolating unit, wherein, the at least one side key is welded onto a ground of the PCB by the metal shell; wherein the part of PCB welded with the at least one side key and the metal shell of the side key collectively form a first ground, and a length of the first ground is ¼ of a wavelength of a radio operating frequency band, and the first ground serves as a radiator of a terminal antenna;

a ground on the PCB except the first ground form a second ground; the second ground is connected with the first ground by at least one first isolating unit, wherein the first isolating unit is used to preventing the radio signal of an operating frequency band from being interfered, and meanwhile avoiding the signals of a non-operating frequency bands from being radiated out;

the antenna receiving/transmitting unit is connected with the first ground;

the second isolating unit is configured to avoid the side key signal wire interfering with the first ground, and the first ground is connected with a corresponding side key signal wire by the second isolating unit.

7. The terminal according to claim 6, wherein, the radio operating frequency band is a Bluetooth operating frequency band, and the length of the first ground is 30 mm;

or, the radio operating frequency band is a Global Positioning System (GPS) frequency band, and the length of the first ground is 48 mm.

8. The terminal according to claim 7, further comprising a matching unit, wherein, the first ground is connected with the antenna receiving/transmitting unit by the matching unit;

the matching unit is configured to match an impedance of the radiator to an input impedance of the antenna receiving/transmitting unit.

9. The terminal according to claim 8, wherein, the matching unit is a T-network composed of an inductor and a capacitor.

10. The terminal according to claim 6, wherein, the at least one first isolating unit is close to the first ground and is distributed evenly;

the second isolating unit is close to the first ground.

11. A terminal antenna, comprising a first ground and at least one side key with a metal shell for fixing the at least one side key, wherein, the at least one side key is welded onto a ground of a printed circuit board, PCB, by the metal shell;

the first ground comprises the part of PCB welded with the side key and the metal shell of the side key, a length of the first ground is ¼ of a wavelength of a radio operating frequency band, and the first ground is a radiator of the terminal antenna;

the first ground is further configured to be connected with a corresponding side key signal wire by a second isolating unit, wherein the second isolating unit is configured to avoid the side key signal wire interfering with the first ground.

12. The terminal antenna according to claim 11, wherein, the first ground is further configured to:

be connected with a second ground by at least one first isolating unit, wherein the second ground is a ground on the PCB except the first ground, the first isolating unit is used to preventing the radio signal of an operating frequency band from being interfered, and meanwhile avoiding the signals of a non-operating frequency bands from being radiated out;

be connected with an antenna receiving/transmitting unit by a matching unit; wherein, the matching unit is configured to match an impedance of a radiator to an input impedance of the antenna receiving/transmitting unit.

13. The terminal antenna according to claim 11, wherein, the radio operating frequency band is a Bluetooth operating frequency band, and a length of the first ground is 30 mm;

or, the radio operating frequency band is a Global Positioning System (GPS) frequency band, and the length of the first ground is 48 mm.

* * * * *